US006431993B1

(12) United States Patent
Dyer

(10) Patent No.: US 6,431,993 B1
(45) Date of Patent: Aug. 13, 2002

(54) GOLF CLUB HOSEL INTERFACE HAVING BENDABLE SECTION FOR CUSTOMIZING LIE AND FACE ANGLES

(75) Inventor: Alonzo J. Dyer, Encinitas, CA (US)

(73) Assignee: The Nirvana Group, L.L.C.

( * ) Notice: Subject to any disclaimer, the term of this patent is extended or adjusted under 35 U.S.C. 154(b) by 0 days.

(21) Appl. No.: 09/511,700

(22) Filed: Feb. 23, 2000

(51) Int. Cl.[7] ..... A63B 53/06
(52) U.S. Cl. ..... 473/246; 473/309
(58) Field of Search ..... 473/244, 245, 473/246, 248, 305, 309, 310, 316–323

(56) References Cited

U.S. PATENT DOCUMENTS 5,184,819 A * 2/1993 Desbiolles
5,259,617 A * 11/1993 Soong
5,335,909 A * 8/1994 Green
5,586,944 A * 12/1996 Nagamoto
5,735,752 A * 4/1998 Antonious
5,910,056 A * 6/1999 Nagamoto

* cited by examiner

*Primary Examiner*—Stephen Blau
(74) *Attorney, Agent, or Firm*—Leonard Tachner

(57) ABSTRACT

A hosel interface device for interconnection of the golf club shaft and the golf clubhead, the device having a portion which is made intentionally bendable to provide any desired extent of variation in lie angle and face angle in virtually an infinite number of increments. The invention employs a bending region along a portion of an otherwise straight exterior hosel interface or coupling. The hosel interface is configured to be inserted into the typical hosel area location of a golf club head such as a wood or iron head. The hosel interface also provides an elongated receptacle for receiving the clubhead end of a shaft. The bending region is between the clubhead insertion region and the shaft receptacle region of the hosel interface.

9 Claims, 3 Drawing Sheets

GOLF CLUB HOSEL INTERFACE HAVING BENDABLE SECTION FOR CUSTOMIZING LIE AND FACE ANGLES

BACKGROUND OF THE INVENTION

1. FIELD OF THE INVENTION

The present invention relates generally to customized golf clubs which are configured to best suit a particular golfer. The invention relates more specifically to a golf club hosel interface having an intentionally bendable portion which permits selected variation in lie angle and face angle without requiring a large inventory of differently configured hosels and without increasing the risk of a fracture.

2. PRIOR ART

Relevant prior art appears in U.S. Pat. No. 5,851,155 to Wood et al. This patent discloses a hosel construction having a plug member and a neck member. The plug member is secured in the golf club head. The neck member extends integrally from the plug member and receives the shaft. The hosel construction is provided in numerous different configurations to provide different lie and face angles. As shown in column 5, lines 49–60, in order to offer deviations of lie angles and face angles which are in the angular range of only + or −1 degree increments, it is necessary to provide nine different hosel constructions. Moreover, as stated in that patent at column 5, lines 44–47, "Only the combinations using deviations of 1°, 0° and −1° are shown. However, additional increments, positive and negative, integer and non-integer, are also contemplated." Thus for example, if it were desired to provide hosel constructions permitting ½° increments in both angles between −1 ½° to +1 ½°, a total of 49 different hosel constructions would be required. If it were desired to provide hosel constructions permitting ⅓° increments in both angles between −2° and +2°, a total of 169 different hosel constructions would be required. Clearly, it can be highly disadvantageous to require such a large inventory of such prior art devices, particularly when each golf club manufactured to a particular combination of lie and face angle will use one of those devices and force its replacement in the full set. Thus the total number of such hosel constructions that must be kept on hand to accommodate even a modest rate of sales, can become entirely too burdensome to be practical. What is needed therefore, is a hosel construction which can satisfy a large range of angles and increments for both lie and face angle variations, but without requiring a burdensome inventory of such hosel constructions.

U.S. Pat. No. 5,626,528 to Toulon discloses a bendable hosel that is cast as one piece with the clubhead body forming an entire clubhead. The hosel being cast of the same material as the rest of the clubhead makes it undesirable for bending as the hosel is heat-treated or hardened the same as the rest of the clubhead. This is a problem since making the hardness range soft enough to bend the hosel will allow the club face to cave-in when the golf ball is struck. Conversely, making the hardness in a range to prevent face cave-ins makes the hosel brittle and very susceptible to fracturing during bending. The Toulon design hosel immediately adjacent to the head has a circumferential slot or groove about the hosel periphery to facilitate bending the hosel to provide variations in the face angle or lie angle. Unfortunately, a circumferential grooved or slotted hosel is inherently weaker and thus susceptible to fracture while making adjustments or hitting the golf ball. The result can be catastrophic failure permitting the clubhead to separate from the shaft during a swing, which could cause serious injury to the golfer or others in proximity of the golfer.

SUMMARY OF THE INVENTION

The present invention overcomes the aforementioned disadvantages of the prior art by providing a hosel interface device having special mechanical design and properties formulated especially for bending. The hosel interface has a varying wall thickness to focus bending in one concentrated area to allow any desired extent of variation in lie and face angle in virtually an infinite number of increments. However, unlike the prior art, there is no circumferential groove or slot in the hosel to weaken it and increase the risk of fracture that could cause separation of the clubhead from the shaft. The hosel invention herein instead is not part of the original clubhead casting with its associated heat-treating or hardening limitations, but is formulated to be mechanically brazed into the clubhead and exhibit specific properties otherwise unattainable if the hosel is cast in entirety with the clubhead. The hosel interface invention herein employs a bending region along a portion of an otherwise straight hosel interface or coupling between an insertion portion that is brazed into the clubhead and another portion that provides a receptacle for the clubhead end of the shaft.

OBJECTS OF THE INVENTION

It is therefore a principal object of the present invention to provide a golf club having a unique hosel interface with a bendable region configured for entry into the clubhead hosel area interior for permitting lie angle and face angle adjustment for each golfer.

It is another object of the present invention to provide a hosel interface for customizing golf clubs, but without requiring an inventory of different hosel interfaces for numerous angle ranges and increments in both lie angle and face angle.

It is yet another object of the invention to provide a bendable hosel interface for customizing golf clubs, but without requiring a circumferentially grooved or slotted hosel which would otherwise reduce the structural integrity of the golf club to an unacceptable degree.

It is yet another object of the invention to be universally applied to any golf club type whether it be a putter, iron, iron wedge, driving iron, driver, fairway wood, trouble wood, or any other type of golf club having an interface between a golf clubhead and shaft.

BRIEF DESCRIPTION OF THE DRAWINGS

The aforementioned objects and advantages of the present invention, as well as additional objects and advantages thereof, will be more fully understood hereinafter as a result of a detailed description of a preferred embodiment when taken in conjunction with the following drawings in which.

DETAILED DESCRIPTION OF A PREFERRED EMBODIMENT

Figure 1:
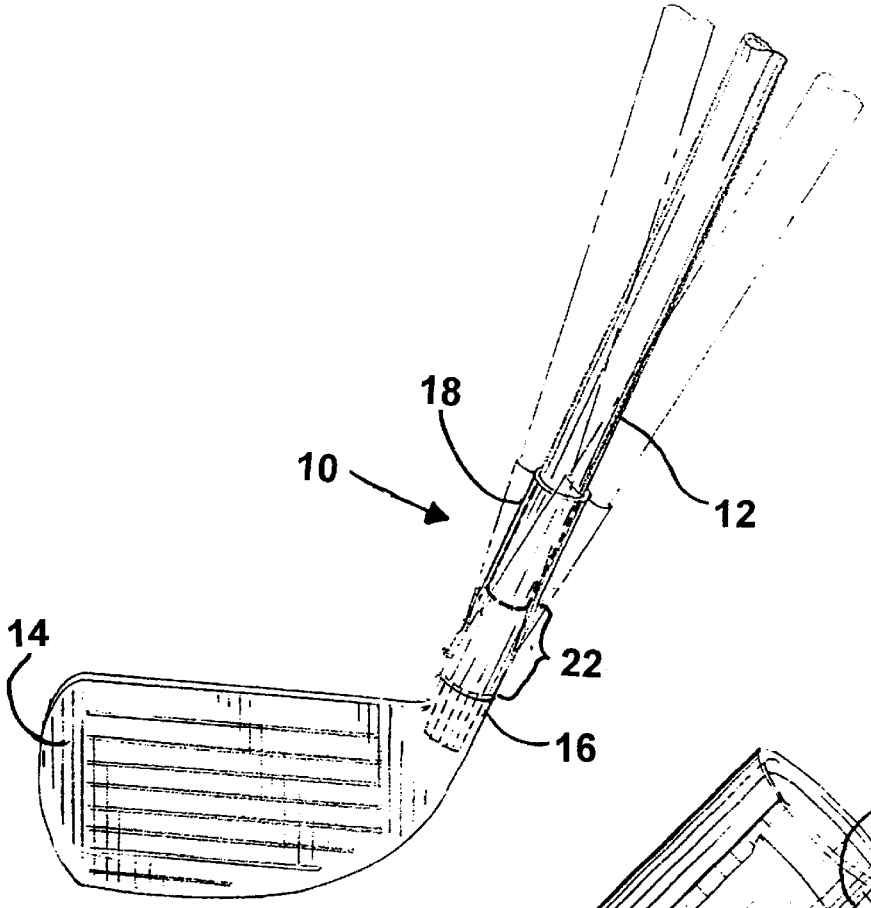
FIG. 1 is an elevational view of a golf club having the hosel interface of the present invention and showing in phantom lines a range of lie angle variation with bending of the interface.
Figure 2:
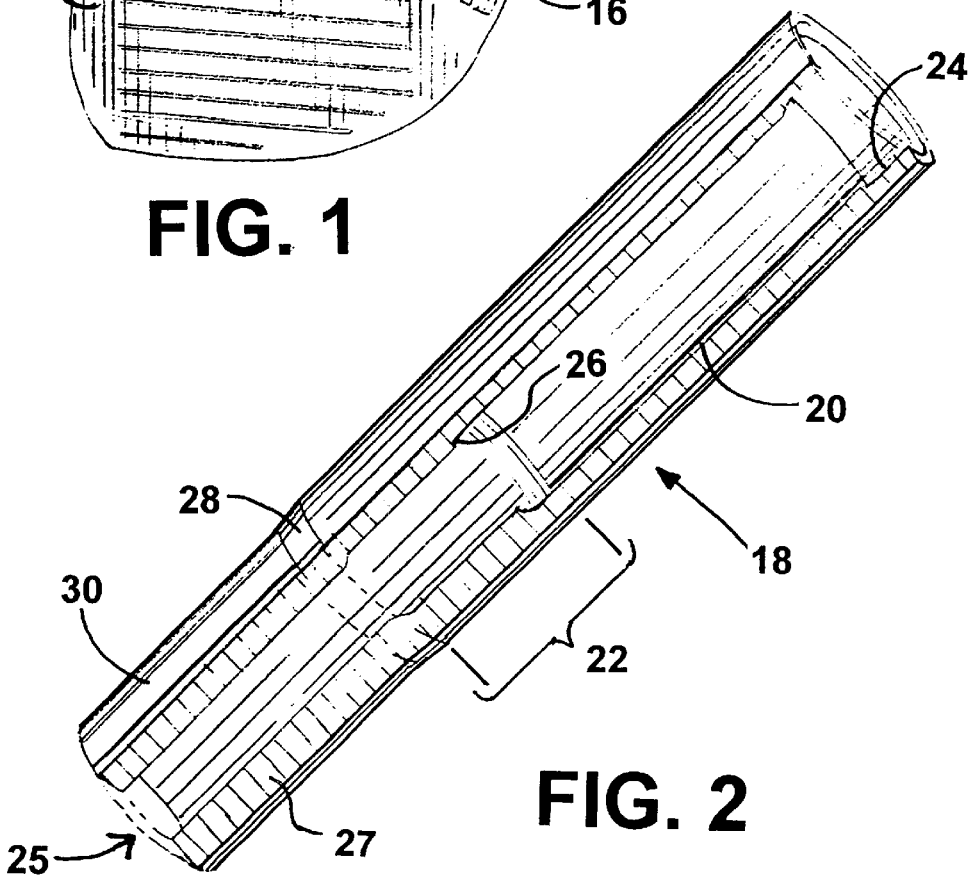
FIG. 2 is an enlarged cut-away view of the hosel interface.
Figure 3:
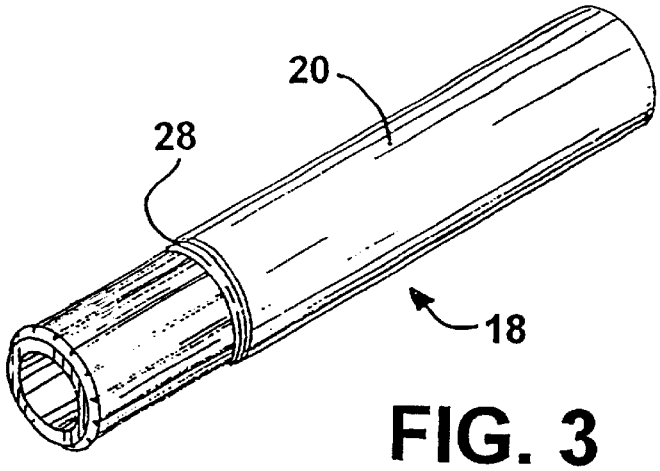
FIG. 3 is a three-dimensional view thereof.
Figure 4:
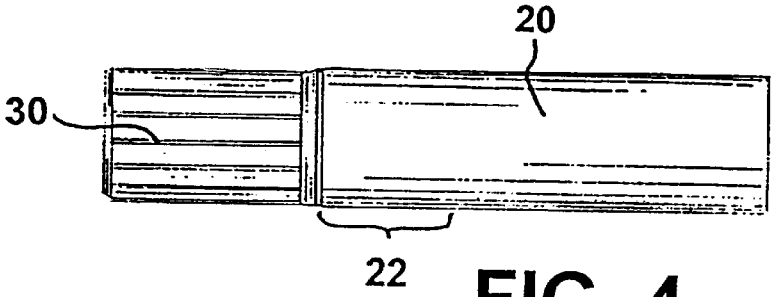
FIG. 4 is a side view thereof.
Figure 5:
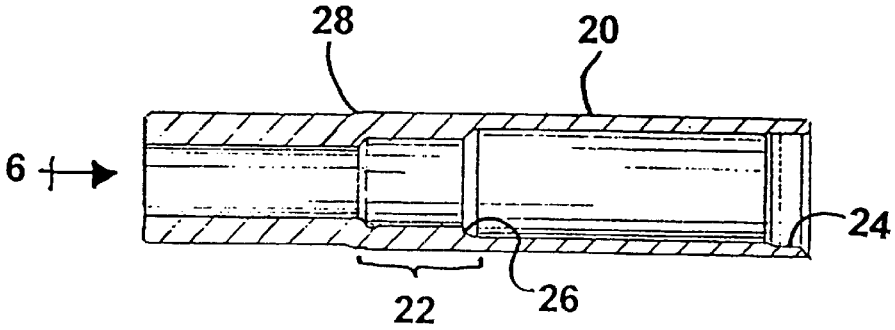
FIG. 5 is a cross-sectional view thereof.
Figure 6:
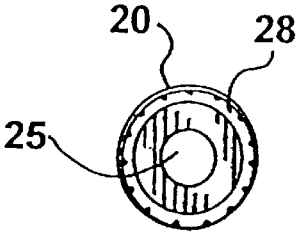
FIG. 6 is an end view thereof.

Referring to the accompanying figures, it will be seen that a golf club 10 comprises a shaft 12 and a golf club head 14 having a hosel 16. The shaft 12 and hosel 16 are interconnected by a hosel interface 18. Hosel interface 18 is an elongated hollow cylinder having an interior chamber 25 and comprises a shaft receptacle 20, an integral bendable section 22 and an insertable section 27.

Figure 7:
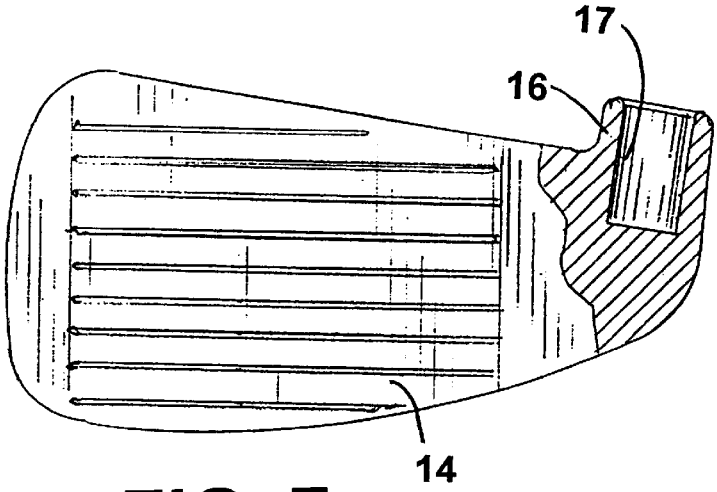
FIG. 7 is a partially cross-sectioned view of an iron head with which the hosel interface may be used to connect the head to a shaft.
Figure 8:
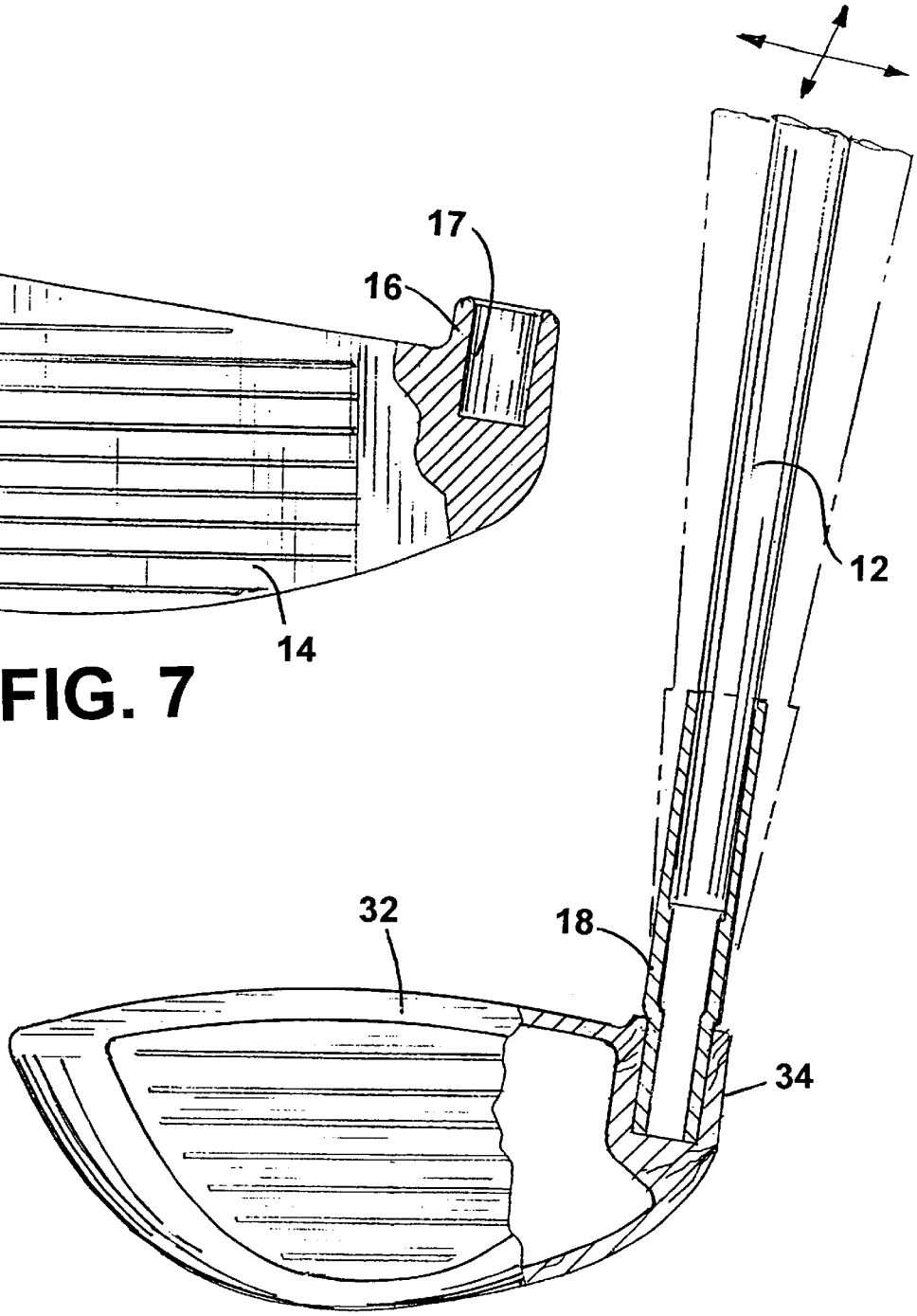
FIG. 8 is a partially cross-sectioned view of a metalwood head and a hosel interface device shown attaching the head to a shaft.

The shaft receptacle 20 has a lead in 24 to facilitate receiving the shaft 12 and an interior shoulder 26 to seat the end of the shaft. An exterior shoulder 28 separates the shaft receptacle 20 and the bendable section 22 from the insertable section 27, the latter having a thickened wall thickness and a plurality of axial score lines 30 to facilitate connection to the hosel 16. By way of example, in FIG. 1 shaft 12 is shown in solid line at one angle relative to head 14 and in phantom line at two opposing alternative angles relative to head 14. Each such alternative angle is achieved by bending the bendable portion 22 of hosel interface 18 in the desired direction away from the axis of the interface. In FIG. 7 the iron head 14 is shown in a more enlarged view with the hosel channel 17 of hosel 16 shown empty. In FIG. 8, a metal wood head 32 having a hosel 34 is shown connected to a shaft 12 by a hosel interface 18 which can be bent in any direction to adjust both lie angle and face angle.

The hosel interface 18 is designed with a material preferably having the following mechanical properties: Tensile strength 96 to 135 Ksi; yield strength 65 to 115 Ksi; elongation 13 to 17%, specific strength 343 to 500 Ksi/lb/in3; hardness 22 to 32 Rockwell hardness C-scale.

The preferred embodiment comprises a 2.375-inch long hollow cylinder with a 1.25-inch long shaft receptacle, a 0.375-inch long bendable region and a 0.750-inch long clubhead insertion region. The outer cylinder diameter is 0.475-inch for the shaft receptacle and bending portion and 0.458-inch for the insertion region. The shaft receptacle has a lead in diameter of 0.395-inch and 0.377-inch inner diameter. The fact that bending portion has a 0.300-inch difference in diameters of the bending region and the insertion region is significant because it forces the bending region to be weaker than the shaft and insertion portions. The insertion region preferably comprises axially directed score lines 30 which provide more surface area and bond thickness and thus renders the brazing at the insertion region stronger and comparable to an all cast clubhead. As a result, lie and/or face angle bends of several degrees are easily accommodated without any significant increase in risk of fracture. Thus, the present invention overcomes the huge and more expensive hosel inventory requirement and the fracture risk of the prior art.

Having thus described a preferred embodiment of the invention, it being understood that many other embodiments of different shape are contemplated, what is claimed is:

1. In a golf club having a shaft and a ball-hitting head, the head having a hosel for interconnecting the shaft and the head; a hosel interface comprising:

an elongated cylindrical body having an axis and a substantially hollow interior, said body having a shaft receptacle for receiving said shaft and an insertable section for insertion into said head, said body also having a bendable section extending from said shaft receptacle to said insertable section, said bendable section having a wall thickness that is less than the wall thickness of said insertable section for rendering said section easier to bend away from said axis to alter the angle between said head and said shaft;

further comprising a shoulder within said hollow interior along said shaft receptacle, said shoulder providing a stop location for said shaft.

2. The hosel interface recited in claim 1 wherein said shaft receptacle comprises a lead in area of increased inner diameter for receiving said shaft.

3. In a golf club having a shaft and a ball-hitting head, the head having a hosel for interconnecting the shaft and the head; a hosel interface comprising:

an elongated cylindrical body having an axis and a substantially hollow interior, said body having a shaft receptacle for receiving said shaft and an insertable section for insertion into said head, said body also having a bendable section extending from said shaft receptacle to said insertable section, said bendable section having a wall thickness that is less than the wall thickness of said insertable section for rendering said section easier to bend away from said axis to alter the angle between said head and said shaft;

further comprising a shoulder formed externally along said cylinder and forming a line of demarcation between said insertable section and said bendable section.

4. The hosel interface recited in claim 3 wherein said shoulder is formed by a reduction in the external diameter of said cylinder.

5. A golf club having a shaft, a head having a hosel and a hosel interface, the hosel interface comprising a bendable portion for selectively altering the angle between the shaft and the head to customize the golf club for each particular golfer; the hosel interface also comprising:

an elongated, channeled cylindrical member having at least two distinct outer diameters, one such outer diameter being that of a shaft receiving portion for attachment to said shaft, the other such outer diameter being that of a hosel insertion portion for attachment to said hosel, the hosel insertion portion being separated from shaft receiving portion by said bendable portion which is readily bent in any selected direction relative to said shaft receiving portion to facilitate said angle altering;

further comprising a shoulder within said channel along said shaft receiving portion, said shoulder providing a stop location for said shaft.

6. A golf club having a shaft, a head having a hosel and a hosel interface, the hosel interface comprising a bendable portion for selectively altering the angle between the shaft and the head to customize the golf club for each particular golfer; the hosel interface also comprising:

an elongated, channeled cylindrical member having at least two distinct outer diameters, one such outer diameter being that of a shaft receiving portion for attachment to said shaft, the other such outer diameter being that of a hosel insertion portion for attachment to said hosel, the hosel insertion portion being separated from shaft receiving portion by said bendable portion which is readily bent in any selected direction relative to said shaft receiving portion to facilitate said angle altering;

further comprising a shoulder formed externally along said cylinder and forming a line of demarcation between said bendable portion and said hosel insertion portion.

7. The hosel interface recited in claim 6 wherein said shoulder is formed by a reduction in the external diameter of said cylinder.

8. The hosel interface recited in claim 6 wherein said shaft receiving portion comprises a lead in area of increased inner diameter for receiving said shaft.

9. The hosel interface recited in claim 6 wherein said hosel insertion portion comprises a plurality of radially spaced axial score lines for making said hosel insertion portion more susceptible to secure attachment to said hosel.

* * * * *